US012234713B2

(12) United States Patent
Fink

(10) Patent No.: US 12,234,713 B2
(45) Date of Patent: Feb. 25, 2025

(54) SYSTEMS AND METHOD FOR EFFICIENT TRANSPORT OF FLUID SEPARATORS

(71) Applicant: CNX Resources Corporation, Canonsburg, PA (US)

(72) Inventor: Joseph M. Fink, Washington, PA (US)

(73) Assignee: CNX Resources Corporation, Canonsburg, PA (US)

( * ) Notice: Subject to any disclaimer, the term of this patent is extended or adjusted under 35 U.S.C. 154(b) by 0 days.

(21) Appl. No.: 17/853,453

(22) Filed: Jun. 29, 2022

(65) Prior Publication Data

US 2024/0003238 A1 Jan. 4, 2024

(51) Int. Cl.
*E21B 34/02* (2006.01)
*E21B 43/34* (2006.01)
*E21B 47/047* (2012.01)

(52) U.S. Cl.
CPC ..... *E21B 43/35* (2020.05); *E21B 34/025* (2020.05); *E21B 47/047* (2020.05)

(58) Field of Classification Search
CPC ..... E21B 34/02; E21B 34/025; E21B 43/34; E21B 43/35; E21B 47/047
See application file for complete search history.

(56) References Cited

U.S. PATENT DOCUMENTS 1,946,182 A 2/1934 Thompson
2,873,814 A 2/1959 Maher
3,312,073 A 4/1967 Jackson et al.
3,808,794 A 5/1974 Wood
4,024,912 A 5/1977 Hamrick et al.
4,139,019 A 2/1979 Bresie et al.
4,169,506 A 10/1979 Berry
4,213,476 A 7/1980 Bresie et al.
4,369,373 A 1/1983 Wiseman
4,479,546 A 10/1984 Bresie et al.
4,483,376 A 11/1984 Bresie et al.
4,579,565 A 4/1986 Heath
4,779,677 A * 10/1988 Cobb ..... E21B 43/34 166/267
5,082,556 A * 1/1992 Reese ..... E21B 43/35 210/123
5,117,908 A 6/1992 Hofman
5,211,842 A * 5/1993 Tuss ..... E21B 43/34 210/194

(Continued)

FOREIGN PATENT DOCUMENTS

CN 101498229 A 8/2009
CN 201318146 9/2009

(Continued)

OTHER PUBLICATIONS

Alpha FlowBack, Euipment Listing, Alpha Flowback Corp, https://alphaflowback.com/equipment/, 2023.

(Continued)

*Primary Examiner* — Matthew R Buck

(57) ABSTRACT

Methods and compositions for skid-mounted separator assemblies are provided. In some embodiments, the compositions comprise at least one mobile skid, wherein the at least one mobile skid has a first frame and a second frame, and wherein the first frame is hingedly coupled to the second frame. In some embodiments, at least one separator is mounted upon the at least one mobile skid.

94 Claims, 7 Drawing Sheets

(56) References Cited

U.S. PATENT DOCUMENTS

| | | | | |
|---|---|---|---|---|
| 5,221,302 | A * | 6/1993 | Sheehan | B65G 53/24 55/341.7 |
| 5,907,924 | A | 6/1999 | Collin et al. | |
| 5,988,283 | A | 11/1999 | Gann | |
| 6,085,546 | A | 7/2000 | Johnston | |
| 6,155,047 | A | 12/2000 | Streetman | |
| 6,269,656 | B1 | 8/2001 | Johnston | |
| 6,401,838 | B1 | 6/2002 | Rezmer-Cooper | |
| 6,824,347 | B2 | 11/2004 | Maloney | |
| 6,825,575 | B1 | 11/2004 | Edelson | |
| 6,901,735 | B2 | 6/2005 | Lohn | |
| 6,998,724 | B2 | 2/2006 | Johansen et al. | |
| 7,048,782 | B1 | 5/2006 | Couch et al. | |
| 7,219,512 | B1 | 5/2007 | Wilding et al. | |
| 7,224,080 | B2 | 5/2007 | Smestad | |
| 7,562,708 | B2 | 7/2009 | Cogliandro et al. | |
| 7,575,672 | B1 | 8/2009 | Gilmore | |
| 7,578,142 | B2 | 8/2009 | Vasiljev et al. | |
| 7,608,935 | B2 | 10/2009 | Scherzer | |
| 7,683,499 | B2 | 3/2010 | Saucier | |
| 7,757,503 | B2 | 7/2010 | Taylor | |
| 7,958,716 | B2 | 6/2011 | Ziegenfuss | |
| 8,268,051 | B2 * | 9/2012 | Hess | B01D 17/02 96/182 |
| 8,375,717 | B2 | 2/2013 | Lourenco et al. | |
| 8,421,258 | B2 | 4/2013 | Pozivil et al. | |
| 8,439,112 | B1 | 5/2013 | Droke | |
| 8,555,671 | B2 | 10/2013 | Lourenco et al. | |
| 8,680,704 | B1 | 3/2014 | Rooney | |
| 8,882,438 | B2 | 11/2014 | Asti et al. | |
| 8,997,904 | B2 | 4/2015 | Cryer et al. | |
| 9,077,220 | B2 | 7/2015 | Kyle et al. | |
| 9,083,213 | B1 | 7/2015 | Nestor et al. | |
| 9,217,422 | B2 | 12/2015 | Davis | |
| 9,243,498 | B2 | 1/2016 | Oxner | |
| 9,394,764 | B2 | 7/2016 | Favilli et al. | |
| 9,803,459 | B1 * | 10/2017 | Leal | B01D 21/2405 |
| 9,937,442 | B2 | 4/2018 | Hendrix | |
| 10,458,206 | B2 | 10/2019 | Al-Dossary et al. | |
| 10,513,899 | B2 | 12/2019 | Cherewyk | |
| 10,612,357 | B2 | 4/2020 | Babcock et al. | |
| 10,655,434 | B2 | 5/2020 | Weflen | |
| 10,717,026 | B1 * | 7/2020 | Anderson | B01D 19/0057 |
| 10,871,062 | B2 | 12/2020 | Gamarra et al. | |
| 10,874,979 | B2 | 12/2020 | Ding et al. | |
| 10,895,141 | B2 | 1/2021 | Elmer | |
| 11,136,874 | B2 | 10/2021 | Arefjord et al. | |
| 11,506,006 | B2 | 11/2022 | Lymberopoulos et al. | |
| 2001/0003247 | A1 | 6/2001 | Lundberg | |
| 2004/0217050 | A1 | 11/2004 | Schmidt et al. | |
| 2006/0070735 | A1 | 4/2006 | Guerra et al. | |
| 2006/0108808 | A1 | 5/2006 | Chen | |
| 2007/0269317 | A1 | 11/2007 | Clancy | |
| 2008/0017369 | A1 | 1/2008 | Sarada | |
| 2010/0077752 | A1 | 4/2010 | Papile | |
| 2011/0114389 | A1 | 5/2011 | Mathena | |
| 2011/0175358 | A1 | 7/2011 | Langson | |
| 2011/0198080 | A1 | 8/2011 | Demong | |
| 2012/0193103 | A1 | 8/2012 | Hall et al. | |
| 2013/0119666 | A1 | 5/2013 | Holt et al. | |
| 2014/0265326 | A1 | 9/2014 | Allen | |
| 2015/0167413 | A1 | 6/2015 | Leuchtenberg et al. | |
| 2016/0138955 | A1 | 5/2016 | Van Der Bos et al. | |
| 2018/0163528 | A1 | 6/2018 | Smith et al. | |
| 2018/0333657 | A1 | 11/2018 | Lyon | |
| 2019/0063203 | A1 | 2/2019 | Arefjord et al. | |
| 2019/0225891 | A1 | 7/2019 | Suppiah et al. | |
| 2020/0056468 | A1 | 2/2020 | Macleod | |
| 2020/0103146 | A1 | 4/2020 | Tunkel et al. | |
| 2022/0074653 | A1 | 3/2022 | Hoffman | |
| 2022/0154568 | A1 | 5/2022 | Fink et al. | |
| 2023/0040989 | A1 * | 2/2023 | Arefjord | E21B 43/40 |

FOREIGN PATENT DOCUMENTS

| | | | | |
|---|---|---|---|---|
| CN | 204387691 | | | 6/2015 |
| CN | 105673263 | | | 6/2016 |
| CN | 205422676 | U | | 8/2016 |
| CN | 107796457 | A | | 3/2018 |
| CN | 108034468 | | | 5/2018 |
| CN | 109372686 | A | | 2/2019 |
| CN | 109519160 | A | | 3/2019 |
| CN | 209129592 | U | | 7/2019 |
| CN | 209510515 | U | | 10/2019 |
| CN | 110886600 | A | | 3/2020 |
| CN | 111188609 | | | 5/2020 |
| CN | 113209762 | A | * | 8/2021 |
| CN | 113431549 | A | * | 9/2021 |
| GB | 1140015 | | | 1/1969 |
| KR | 10-2016-0139674 | A | | 12/2016 |
| RU | 2270396 | C1 | | 1/2006 |
| WO | 2003/081038 | A1 | | 10/2003 |
| WO | WO2015051246 | A1 | | 4/2015 |
| WO | 2021/105725 | A1 | | 6/2021 |
| WO | 2021151515 | A1 | | 8/2021 |

OTHER PUBLICATIONS

Rahman, Mohammed Mahbubur. "Power generation from pressure reduction in the natural gas supply chain in Bangladesh." Journal of Mechanical Engineering 41.2 (2010): 89-95.

Retnanto, Albertus, and Mohamed Idris. "An Energy Harvesting Alternative to Wellhead Gas Chokes." Proceedings of the International Conference on Industrial Engineering and Operations Management, Bangkok, Thailand, Mar. 5-7, 2019, 11 pages.

Xiao, Jinjiang X., et al. "Well Site Energy Harvesting from High-Pressure Gas Production." Saudi Aramco Journal of Technology (2014). 5 pages.

Rose, Marlee, "High Pressure Separators for Oil & Natural Gas Production" found at https://medium.com/@marleerosegreasebook/high-pressure-separators-for-oil-natural-gas-production-830301af0b46, 2017, 7 pages.

Dorsett, L. R. "LTX: Realization of Proven Technology." SPE Gas Technology Symposium. SPE Paper 19080 (1989), 3 pages.

Enercorp, "Enercorp's Sahara Advanced Cyclone Technology Captures 99.7% of Sand in the Permian Basin", found at https://enercorp.net/permian-basin-flowback-case-study/, 4 pages.

SOR Inc., "1400 Series Control Valves" found at https://www.sorinc.com/assets/images/uploads/2017/04/1400-Series-Control-Valves_CAT1639.pdf, Apr. 2018, 14 pages.

International Search Report and Written Opinion issued in related PCT Application No. PCT/US2021/054214 mailed Jan. 28, 2022, 17 pages.

Notification of transmittal of the international search report and the written opinion of the international searching authority, or the declaration, Sep. 8, 2023, Application No. PCT/US2023/066874, 13 pages.

* cited by examiner

SYSTEMS AND METHOD FOR EFFICIENT TRANSPORT OF FLUID SEPARATORS

TECHNICAL FIELD

The present disclosure relates to transportation and deployment of fluid and gas separation systems in oil and gas applications, and more particularly, to a separator system having one or more separators, valving systems, junk catchers, instrumentation, and other ancillary equipment capable of being delivered to a wellsite upon a single skid. This system can also serve as an alternative to conventional well flowback operations.

The entire disclosure of U.S. Patent Application Publication No. 2022/0154568 A1, filed Sep. 9, 2021, is incorporated by reference herein.

BACKGROUND

In the production of oil and gas, a separator vessel is needed to remove gas, aqueous liquids, and solids from any oil of interest before it is sent to be refined, and also to remove liquids and solids from any natural gas of interest before it is sold or processed. This type of separator is typically trucked to a wellsite, hoisted from its trailer, and placed on the ground, where it is then manually connected to a wellhead and to other equipment such as a valving system, a junk catcher, and/or other separators. Once the separator is no longer needed, it is disconnected from all associated equipment, hoisted back onto its trailer, and transported away from the wellsite. The hoisting of the separator vessel (which is typically very large and heavy, and thus typically requires a crane at each pickup and delivery location) and the manual assembly of a complex and extensive production piping system, often joined with hammer unions, every time the separator is deployed makes the process time-consuming, expensive, prone to mistakes, and potentially unsafe. Moreover, as production systems become instrumented and automated, setup becomes more complex and time-consuming. Therefore, a simpler, faster, and more reliable system for setting up and tearing down a production separator vessel is desired.

SUMMARY

Embodiments of the present disclosure are generally directed to transportation and deployment of fluid and gas separation systems in oil and gas applications, and more particularly, to a separator system having one or more separators, valving systems, junk catchers, instrumentation, and other ancillary equipment capable of being delivered to a wellsite upon a single skid. The systems and methods disclosed herein may be used to transport a skid-mounted separator assembly (including one or more separators, one or more valving systems, and one or more junk catchers) to a wellsite on a single skid via a trailer, preferably a self-lifting trailer such as a silo setter. In certain embodiments, two frames may be hingedly coupled upon a skid. The two frames may collectively carry one or more separators, one or more valving systems, one or more junk catchers, and electronics. The two frames may be oriented vertically or horizontally upon a single skid during transport. The two frames may constitute the skid itself. A mobile skid is a skid that is capable of being transported via a trailer (for example, and without limitation, a truck, silo setter, or crane) without undue difficulty. One of the two frames may rest horizontally during production, while the other frame may stand vertically. When a separator assembly is ready to move from a wellsite, a mechanism may rotate one of the two frames such that the frames are parallel to one another for transport. The separator assembly's actuated valves may be electric, pneumatic, or any combination thereof. In certain embodiments, the separator assembly may include electronics to allow for one or more of pressure, temperature, liquid level, and flow rate monitoring, as well as one or more of local control, remote-control, lighting, video surveillance, backup power, and/or a human-machine interface ("HMI"). In certain embodiments, the separator may be a "super separator"; that is, it may be capable of maintaining high fluid pressure to produce one or more of compressed natural gas ("CNG"), liquified natural gas ("LNG"), electricity, hydrogen, and oxygen. The hydrogen and oxygen may be produced via electrolysis using the system's generated electricity. In certain embodiments, the electricity may be generated by sending high-pressure fluids through a turboexpander.

The present disclosure embodies several unique advantages over conventional flowback equipment. For example, certain embodiments allow for faster setup (and therefore shortened cycle times) at a wellsite. Furthermore, certain embodiments may reduce labor and transport costs by consolidating the separator(s), valving system(s), junk catcher(s), and electronics onto a single skid. Moreover, certain embodiments may achieve lower emissions than conventional methods by (1) reducing the number of trailers necessary to deliver equipment to a wellsite; and (2) producing zero-emission or near-zero-emission energy via pressurized fluids through the use of a super separator. These and other advantages of the systems and methods of the present disclosure may be used to increase the efficiency of wellsite operations. Deploying this equipment in close proximity to the wellhead and operating it in tandem with conventional production equipment offers an alternative to conventional flowback and/or well cleanup operations.

Some embodiments of the present disclosure are generally directed at a system for delivering a separator to a wellbore. In some non-limiting embodiments, the system includes at least one mobile skid. The at least one mobile skid includes a first frame and a second frame, and the first frame is hingedly coupled to the second frame. The system further includes at least one separator mounted upon the at least one mobile skid.

In some non-limiting embodiments, the at least one separator is mounted upon the first frame.

In some non-limiting embodiments, one or more of the following components are mounted to the second frame: (1) a first isolation valving system; (2) a first junk catcher; and (3) a first automated level control valve.

In some non-limiting embodiments, the system further includes a liquid level sensor mounted to the first frame.

In some non-limiting embodiments, the at least one mobile skid is removably mounted upon a trailer.

In some non-limiting embodiments, the trailer is a self-setting trailer.

In some non-limiting embodiments, the at least one separator is fluidly coupled to the wellbore, and the wellbore penetrates into a subterranean surface, the subterranean surface including a reservoir containing one or more hydrocarbons.

In some non-limiting embodiments, a fluid including one or more of gas, liquid, sand, and debris is produced from the wellbore and directed into the at least one separator.

In some non-limiting embodiments, the at least one separator includes a vessel defining an interior chamber, the vessel capable of operating at a pressure greater than the pressure of the fluid. In some non-limiting embodiments, the at least one separator further includes an inlet through which the fluid is directed into the vessel. In some non-limiting embodiments, the at least one separator further includes an outlet through which the gas is directed out of the vessel at a pressure substantially equal to the pressure of the fluid being produced from the wellbore. In some non-limiting embodiments, the at least one separator further includes at least one liquid level sensor capable of detecting a level of liquid within the interior chamber of the vessel at the pressure of the fluid being produced from the wellbore. In some non-limiting embodiments, the at least one separator further includes an electronically controlled valve in fluid communication with a lower portion of the vessel. In some non-limiting embodiments, the at least one separator further includes a controller connected to the at least one liquid level sensor and the electronically controlled valve, the controller programmed to open, close, or modulate the electronically controlled valve to regulate the combined flow of the liquid, sand and debris out of the lower portion of the vessel at least partially in response to the level of the liquid in the interior chamber of the vessel detected by the at least one liquid level sensor.

In some non-limiting embodiments, the first frame is approximately perpendicular to the surface.

In some non-limiting embodiments, the second frame is approximately parallel to the surface.

In some non-limiting embodiments, at least one outlet of the at least one separator is coupled to a GPU.

In some non-limiting embodiments, the GPU is in fluid communication with the at least one separator, and the at least one separator is coupled to an open outlet of the wellbore and a closed outlet of the wellbore.

In some non-limiting embodiments, the system further includes a choke valve in fluid communication with the at least one separator.

In some non-limiting embodiments, the first junk catcher and the choke valve are in fluid communication with the first isolation valving system.

In some non-limiting embodiments, the first isolation valving system is automated.

In some non-limiting embodiments, the system further includes one or more electronics coupled to one or more of the first frame and the second frame, the one or more electronics comprising one or more of a camera, a light source, and an HMI.

In some non-limiting embodiments, the first isolation valving system comprises one or more electric valves, one or more pneumatic valves, or any combination thereof.

In some non-limiting embodiments, the system further includes one or more choke valves, one or more switching valves, one or more purge valves, one or more manual valves, or any combination thereof.

In some non-limiting embodiments, the system further includes one or more logic controllers communicatively coupled to the first isolation valving system.

In some non-limiting embodiments, the one or more logic controllers include one or more of an FIC, an LIC, and a PIC.

In some non-limiting embodiments, the system further includes one or more sensors in electronic communication with the one or more FICs, the one or more LICs, the one or more PICs, the one or more logic controllers, and/or one or more HMIs.

In some non-limiting embodiments, one or more valves are actuated via the one or more LICs, one or more FICs, one or more PICs, one or more logic controllers, and/or one or more HMIs at least in part based on a signal from the one or more sensors.

In some non-limiting embodiments, the one or more sensors comprise one or more flow sensors, one or more liquid level sensors, and/or one or more pressure sensors.

In some non-limiting embodiments, the system further includes one or more HMIs for system monitoring and control.

In some non-limiting embodiments, at least one HMI is located remote from the mobile skid.

In some non-limiting embodiments, the at least one separator is equipped with a second isolation valving system, a second junk catcher, and a second automated level control valve arranged in parallel to the first isolation valving system, the first junk catcher, and the first automated level control valve.

Some embodiments of the present disclosure are generally directed at a method for delivering a separator to a wellbore. In some non-limiting embodiments, the method includes transporting a mobile skid to a surface near the wellbore, the mobile skid including a first frame coupled to a second frame via a hinge. In some non-limiting embodiments, the method further includes coupling at least one separator to the wellbore, wherein the at least one separator is mounted upon the mobile skid.

In some non-limiting embodiments, the method further includes mounting the mobile skid upon a trailer.

In some non-limiting embodiments, the method further includes raising or lowering one or more of the first frame and the second frame such that the second frame is disposed at an angle between 60 degrees and 120 degrees with respect to the first frame.

In some non-limiting embodiments, the method further includes lowering the mobile skid such that both the first frame and the second frame are approximately parallel to the surface and raising the first frame such that it is approximately perpendicular to the surface and such that it is disposed at an angle between 60 degrees and 120 degrees with respect to the second frame.

In some non-limiting embodiments, the mobile skid is lowered before disconnecting the mobile skid from the trailer, and the first frame is raised after disconnecting the mobile skid from the trailer.

In some non-limiting embodiments, the method further includes raising the mobile skid such that both the first frame and the second frame are approximately perpendicular to the surface and lowering the second frame such that it is approximately parallel to the surface and such that it is disposed at an angle between 60 degrees and 120 degrees with respect to the first frame.

In some non-limiting embodiments, the mobile skid is raised before disconnecting the mobile skid from the trailer, and wherein the second frame is lowered after disconnecting the mobile skid from the trailer.

In some non-limiting embodiments, the method further includes raising the second frame relative to the first frame such that the second frame is disposed at an angle within 5 degrees of parallel to the first frame and reconnecting the mobile skid to the trailer.

In some non-limiting embodiments, the method further includes lowering the first frame relative to the second frame such that the first frame is disposed at an angle within 5 degrees of parallel to the second frame and reconnecting the mobile skid to the trailer.

In some non-limiting embodiments, the at least one separator is mounted upon the first frame.

In some non-limiting embodiments, the method further includes sensing, via a liquid level sensor, a liquid level within a vessel of the at least one separator.

In some non-limiting embodiments, the method further includes actuating at least one automated level control valve based at least in part on a signal from the liquid level sensor.

In some non-limiting embodiments, at least one isolation valving system and at least one junk catcher are mounted upon the second frame.

In some non-limiting embodiments, a fluid comprising one or more of gas, liquid, sand, and debris is produced from the wellbore and directed into the at least one separator.

In some non-limiting embodiments, the at least one separator includes: (1) a vessel defining an interior chamber, the vessel capable of operating at a pressure greater than the pressure of the fluid; (2) an inlet through which the fluid is directed into the vessel; (3) an outlet through which the gas is directed out of the vessel at a pressure substantially equal to the pressure of the fluid being produced from the wellbore; (4) at least one liquid level sensor capable of detecting a level of liquid within the interior chamber of the vessel at the pressure of the fluid being produced from the wellbore; (5) an electronically controlled valve in fluid communication with a lower portion of the vessel; and (6) a controller connected to the at least one liquid level sensor and the electronically controlled valve, the controller programmed to open, close, or modulate the electronically controlled valve to regulate the combined flow of the liquid, sand and debris out of the lower portion of the vessel at least partially in response to the level of the liquid in the interior chamber of the vessel detected by the at least one liquid level sensor.

In some non-limiting embodiments, at least one outlet of the at least one separator is coupled to a GPU.

In some non-limiting embodiments, the method further includes coupling the at least one separator to an open outlet of the wellbore and a closed outlet of the wellbore and allowing a portion of the fluid to flow from the at least one separator to a GPU.

Some embodiments of the present disclosure are generally directed at a system for delivering a separator to a wellbore. In some non-limiting embodiments, the system includes at least one mobile skid, wherein the at least one mobile skid includes a first frame and a second frame, and wherein the first frame is hingedly coupled to the second frame. In some non-limiting embodiments, the system further includes at least one wellbore penetrating a subterranean surface including a reservoir containing one or more hydrocarbons, wherein a fluid including one or more of gas, liquid, sand, and debris is produced from the wellbore. In some non-limiting embodiments, the system further includes at least one separator mounted upon the at least one mobile skid and in fluid communication with the reservoir via the at least one wellbore. In some non-limiting embodiments, the at least one separator includes a vessel defining an interior chamber, the vessel capable of operating at a pressure greater than the pressure of the fluid. In some non-limiting embodiments, the at least one separator further includes an inlet through which the fluid is directed from the at least one wellbore into the vessel. In some non-limiting embodiments, the at least one separator further includes an outlet through which the gas is directed out of the vessel at a pressure substantially equal to the pressure of the fluid being produced from the at least one wellbore. In some non-limiting embodiments, the at least one separator further includes at least one liquid level sensor capable of detecting a level of liquid within the interior chamber of the vessel at the pressure of the fluid being produced from the at least one wellbore. In some non-limiting embodiments, the at least one separator further includes an electronically controlled valve in fluid communication with a lower portion of the vessel. In some non-limiting embodiments, the at least one separator further includes a controller connected to the at least one liquid level sensor and the electronically controlled valve, the controller programmed to open, close, or modulate the electronically controlled valve to regulate the combined flow of the liquid, sand and debris out of the lower portion of the vessel at least partially in response to the level of the liquid in the interior chamber of the vessel detected by the at least one liquid level sensor.

In some non-limiting embodiments, the at least one separator is mounted upon the first frame.

In some non-limiting embodiments, the system further includes one or more of the following components mounted to the second frame: (1) a first isolation valving system; (2) a first junk catcher; and (3) a first automated level control valve.

In some non-limiting embodiments, the at least one mobile skid is removably mounted upon a trailer.

In some non-limiting embodiments, the trailer is a self-setting trailer.

In some non-limiting embodiments, the first frame is approximately perpendicular to the subterranean surface.

In some non-limiting embodiments, the second frame is approximately parallel to the subterranean surface.

In some non-limiting embodiments, at least one outlet of the at least one separator is coupled to a GPU.

In some non-limiting embodiments, the GPU is in fluid communication with the at least one separator, and the at least one separator is coupled to an open outlet of the wellbore and a closed outlet of the wellbore.

In some non-limiting embodiments, the system further includes a choke valve in fluid communication with the at least one separator.

In some non-limiting embodiments, the first junk catcher and the choke valve are in fluid communication with the first isolation valving system.

In some non-limiting embodiments, the first isolation valving system is automated.

In some non-limiting embodiments, the system further includes one or more electronics coupled to one or more of the first frame and the second frame, the one or more electronics including one or more of a camera, a light source, and an HMI.

In some non-limiting embodiments, the first isolation valving system includes one or more electric valves, one or more pneumatic valves, or any combination thereof.

In some non-limiting embodiments, the system further includes one or more choke valves, one or more switching valves, one or more purge valves, one or more manual valves, or any combination thereof.

In some non-limiting embodiments, the system further includes one or more logic controllers communicatively coupled to the first isolation valving system.

In some non-limiting embodiments, the one or more logic controllers include one or more of an FIC, an LIC, and a PIC.

In some non-limiting embodiments, the system further includes one or more sensors in electronic communication with the one or more FICs, the one or more LICs, the one or more PICs, the one or more logic controllers, and/or one or more HMIs.

In some non-limiting embodiments, one or more valves are actuated via the one or more LICs, one or more FICs, one or more PICs, one or more logic controllers, and/or one or more HMIs at least in part based on a signal from the one or more sensors.

In some non-limiting embodiments, the one or more sensors include one or more flow sensors, one or more liquid level sensors, and/or one or more pressure sensors.

In some non-limiting embodiments, the system further includes one or more HMIs for system monitoring and control.

In some non-limiting embodiments, at least one HMI is located remote from the mobile skid.

In some non-limiting embodiments, the at least one separator is equipped with a second isolation valving system, a second junk catcher, and a second automated level control valve arranged in parallel to the first isolation valving system, the first junk catcher, and the first automated level control valve.

These and other features and characteristics of the disclosed systems and methods for transporting fluid separators will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the disclosure. As used in the specification and the claims, the singular forms of "a", "an", and "the" include plural referents unless the context clearly dictates otherwise.

BRIEF DESCRIPTION OF THE DRAWINGS

For a more complete understanding of the present disclosure and its features and advantages, reference is now made to the following description, taken in conjunction with the accompanying drawings, in which.

DETAILED DESCRIPTION

For purposes of the description hereinafter, it is to be understood that the disclosure may assume alternative variations and step sequences, except where expressly specified to the contrary. It is also to be understood that the specific devices and processes illustrated in the attached drawings and described in the following specification are simply exemplary aspects of the disclosure. Hence, specific dimensions and other physical characteristics related to the aspects disclosed herein are not to be considered as limiting.

As used herein, the term "coupled" should be understood to include any direct or indirect connection between two things, including, and without limitation, a physical connection (including, and without limitation, a wired or mechanical connection), a non-physical connection (including, and without limitation, a wireless connection), a fluid connection (including, and without limitation, a connection allowing for fluid communication), or any combination thereof. Furthermore, the words "comprising" (and any form of comprising, such as "comprise" and "comprises"), "having" (and any form of having, such as "has" and "have"), "including" (and any form of including, such as "includes" and "include") or "containing" (and any form of containing, such as "contains" and "contain") are to be understood as inclusive and open-ended and do not exclude additional, unrecited elements or method steps. Additionally, the terms "fluid" and "fluids" are to be understood as comprising one or more gases, one or more liquids, one or more solids carried by the flow of one or more gases and/or one or more liquids, and any combination thereof. As used herein, the words "trailer" or "trailers" are to be understood to include any method of ground-based transportation for oilwell equipment known in the art, including, and without limitation, trucks, cranes, and their singular equivalents.

As used herein, the term "at least one of" is synonymous with "one or more of" For example, the phrase "at least one of A, B, and C" means any one of A, B, and C, or any combination of any two or more of A, B, and C. For example, "at least one of A, B, and C" includes one or more of A alone; or one or more of B alone; or one or more of C alone; or one or more of A and one or more of B; or one or more of A and one or more of C; or one or more of B and one or more of C; or one or more of all of A, B, and C. Similarly, as used herein, the term "at least two of" is synonymous with "two or more of" For example, the phrase "at least two of D, E, and F" means any combination of any two or more of D, E, and F. For example, "at least two of D, E, and F" includes one or more of D and one or more of E; or one or more of D and one or more of F; or one or more of E and one or more of F; or one or more of all of D, E, and F.

Figure 1:
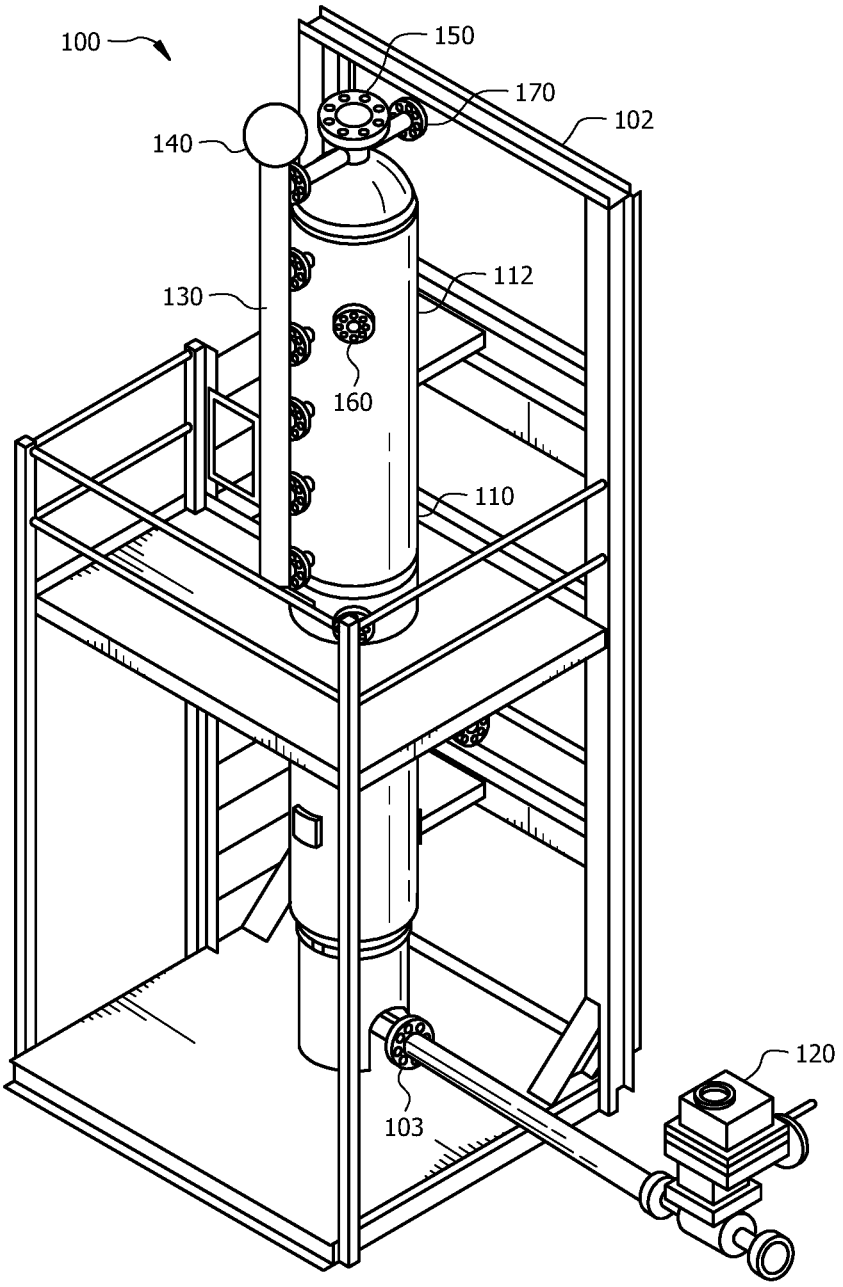
FIG. 1 is a perspective view of a skid, according to one or more embodiments.

FIG. 1 is a perspective view of a skid according to one or more embodiments of the present disclosure. In certain embodiments, the skid 100 may include a sand and liquid separator 110 adapted for use at natural gas wells. The main body 112 of the separator 110 is generally a hollow vessel. One or more fluid outlet ports 103 may be provided at or near a lower portion of the interior chamber of the separator 110 for discharging for example, liquid, sand and debris. One or more inlets (not shown) may allow flow into the interior chamber of the separator 110 from a wellbore (not shown). The wellbore may penetrate into a subterranean surface comprising a reservoir containing one or more hydrocarbons. A fluid outlet port 103 may be fluidly connected to a valve 120 which may be periodically and/or continuously opened and closed to discharge liquid and solid contaminants collected at the bottom of the interior chamber of the separator 110. In certain embodiments, a bridle 130 with a liquid level sensor 140 may be provided to indicate a liquid level in the interior chamber of the separator 110. In certain embodiments, a gas outlet (for example, gas outlet port 150) may be provided in the main body 112 through which gas may flow out of the separator 110 to downstream components of the facility, such as conventional oil and gas equipment, a line heater, or a natural gas dryer. In certain embodiments, an upper sensor port 160 may be provided in the main body 112 of the separator 110 and may receive an upper limit sensor (not shown), such as a limit switch, float switch, thermal dispersion switch, or the like. In one or more embodiments, the upper sensor port 160 may be located vertically above the uppermost bridle port (not shown) and vertically below the gas outlet port 150. A relief valve 170 may be provided at or near the top of the main body 112 and may be configured to open at a predetermined pressure to allow pressurized gases to escape from the interior chamber of the separator 110. The main body 112 may be supported in a vertical or horizontal position by a frame 102.

FIG. 1 depicts a particular embodiment of a skid in accordance with the present disclosure. Those having skill in the pertinent art will understand that any one or more sand and liquid separators suitable for placement upon a skid fall within the scope of the present disclosure. Such separators may operate according to traditional principles or may be super separators—that is, in some embodiments of the present disclosure, high pressure of the gas removed from fluid, sand, and debris may be used for the production one or more of CNG, LNG, electricity, hydrogen, oxygen, and other end products. These products may be produced individually or simultaneously in any combination, without compression, and free of emissions, with or without also providing natural gas to a pipeline. For example, in certain embodiments, high-pressure fluids may be sent through a turboexpander to produce electricity for use in powering the production and other well equipment on site as well as uploading into the grid. Though FIG. 1 depicts a single separator, note that the separator assemblies of the present disclosure may include one or more separators.

In certain embodiments, the interior chamber of the separator 110 may comprise a vessel, wherein the vessel is capable of operating at a pressure greater than that of fluid produced from the wellbore. An electronically controlled valve may be in fluid communication with a lower portion of the vessel, and a controller may be connected to the electronically controlled valve and one or more sensors. The one or more sensors may comprise one or more of liquid level sensor(s), pressure sensor(s), and flow sensor(s). The controller may be programmed to open, close, or modulate the electronically controlled valve to regulate the combined flow of the liquid, sand and debris out of the lower portion of the vessel. In certain embodiments, the controller may direct the electronically controlled valve in response to a level of liquid, a pressure, and/or a liquid flow detected by the one or more sensors.

In certain embodiments, a separator assembly may be equipped with one or more equalization ports. In certain embodiments, one or more separators may be equipped with one or more choke valves, switching valves, and/or isolation valves. In certain embodiments, one or more valves may be automated, such that the one or more valves actuate based at least in part on one or more inputs from one or more sensors (for example, and without limitation, fluid level sensors) within the system. In certain embodiments, the separator assembly may be outfitted such that one or more valves may be actuated via a human-machine interface. The separator assembly may be operated remotely, locally, or any combination thereof.

In some non-limiting embodiments, one or more junk catchers or strainers may be transported with a separator 110. In some non-limiting embodiments, one or more valving systems may be transported with a separator 110. A valving system may incorporate one or more control valves, isolation valves, automated valves, manual valves, and any combination thereof. During production, the one or more junk catchers or strainers may be coupled to the one or more valving systems, and the one or more valving systems may be coupled to one or more separators 110. The one or more junk catchers or strainers may be located downstream from the one or more separators and may capture debris. Liquid, sand, and debris separated from the gas may pass through the one or more junk catchers or strainers so as to not clog the downstream choke valve or any other component of the system. Downstream of separator 110, gas and any liquid allowed to carry out of the separator may be connected to the inlet of a conventional gas production unit ("GPU") through which further liquid and gas separation may occur. In certain embodiments, a GPU may modulate pressure and/or introduce heat to safeguard against the freezing effects of the pressure reduction. In certain embodiments, a GPU may be omitted from the system entirely.

Figure 2:
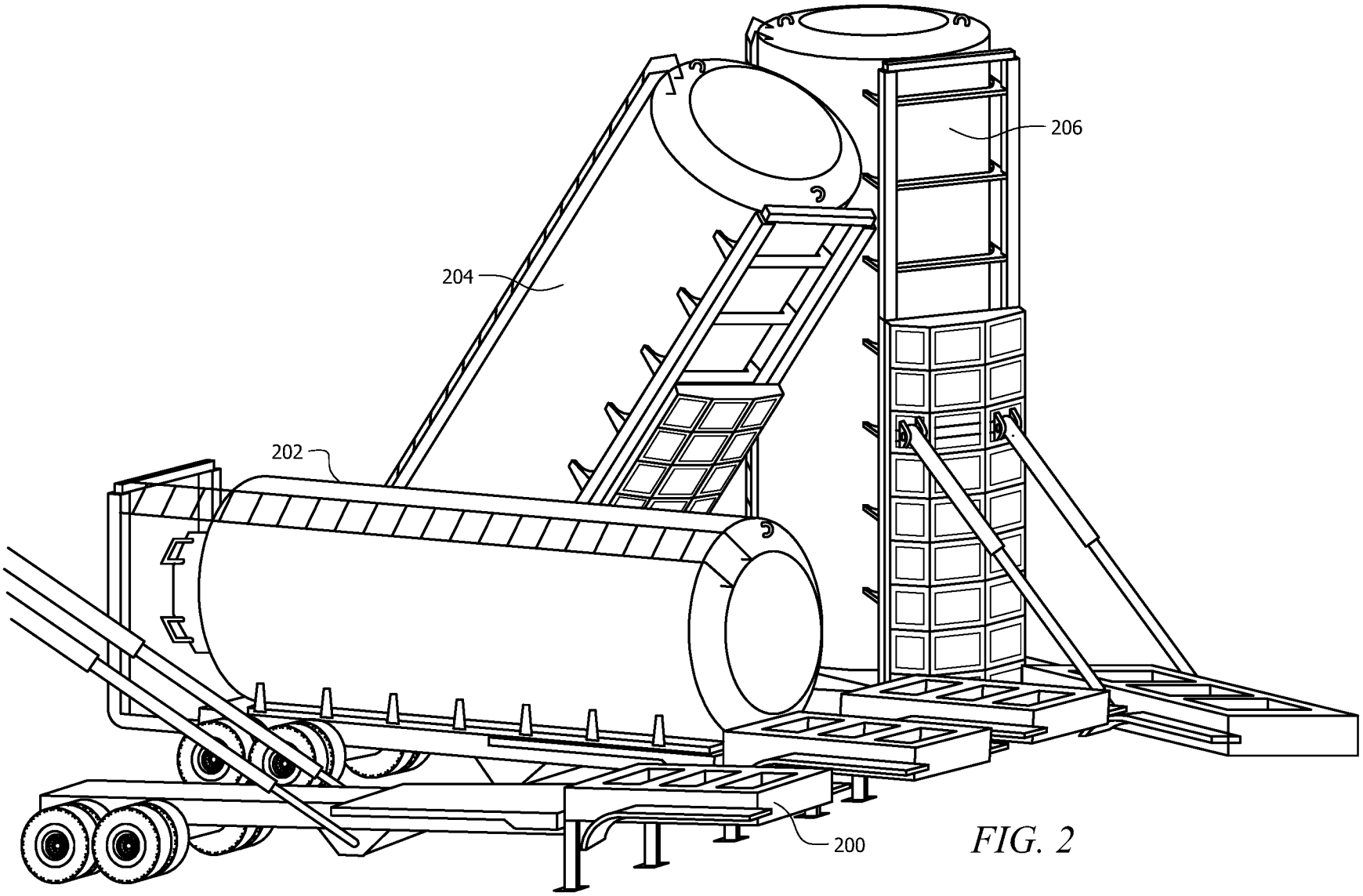
FIG. 2 is a perspective view of a silo setter, according to one or more embodiments.

FIG. 2 is a perspective view of a silo setter, according to one or more embodiments of the present disclosure. A silo setter 200 may be used to lift and/or transport an object 202. In certain embodiments, the object 202 may be a separator assembly (not shown). In certain embodiments, some or all of the skid-mounted separator assembly may be hoisted from a horizontal position 202, past diagonal position 204, to a vertical position 206. In certain embodiments, the skid-mounted separator assembly may comprise one or more separators, junk catchers/strainers, and/or valving systems. Though FIG. 2 depicts a silo setter, all suitable trailers (that is, all suitable land-based mechanisms for transporting oilfield equipment) fall within the scope of the present disclosure, including (and without limitation) other lifting trailers.

Several orientations and transportation steps may be performed with respect to the skid-mounted system. In one illustrative embodiment, the two frames may be transported upon a single skid on a trailer in a horizontal orientation. In certain embodiments, the trailer may be a silo setter as depicted in FIG. 2. The two frames may rest upon a skid or may constitute the skid itself. Upon arrival at a wellsite, the two frames may be unloaded from the trailer in a vertical orientation; in other words, the unloading process from the trailer may result in the two frames being rotated from a horizontal orientation to a vertical orientation. A first frame may carry one or more separators, and a second frame may carry one or more junk catchers, valving systems, and/or electronics. Once set upon the ground, the second frame may pivot from a vertical orientation to a horizontal orientation, such that it is perpendicular to the first frame. Once the two frames are oriented perpendicular to one another, the one or more separators may be used to separate produced fluids. After production through the separator(s) is halted, the second frame may be pivoted back to a vertical position such that it is parallel to the first frame. The two frames may then be rotated to a horizontal position as they are loaded upon a trailer. Note that the embodiments listed in this paragraph are purely illustrative; the frames may be delivered and used in any orientation, and the separator assembly elements may be located in any combination upon the first and second frames.

Figure 3A:
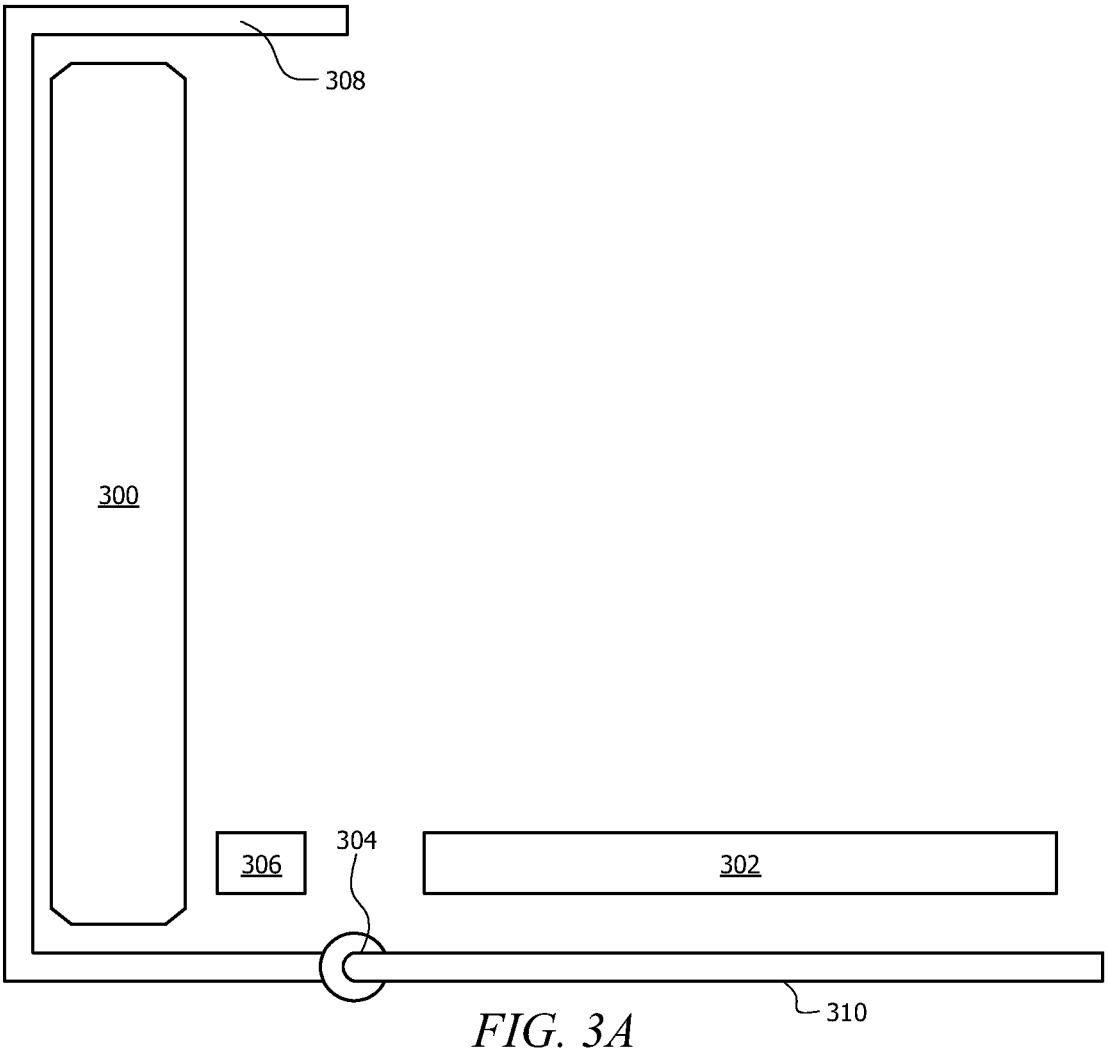
FIG. 3A is a side-view block diagram illustrating general components of a deployed skid-mounted separator assembly, according to one or more embodiments.
Figure 3B:
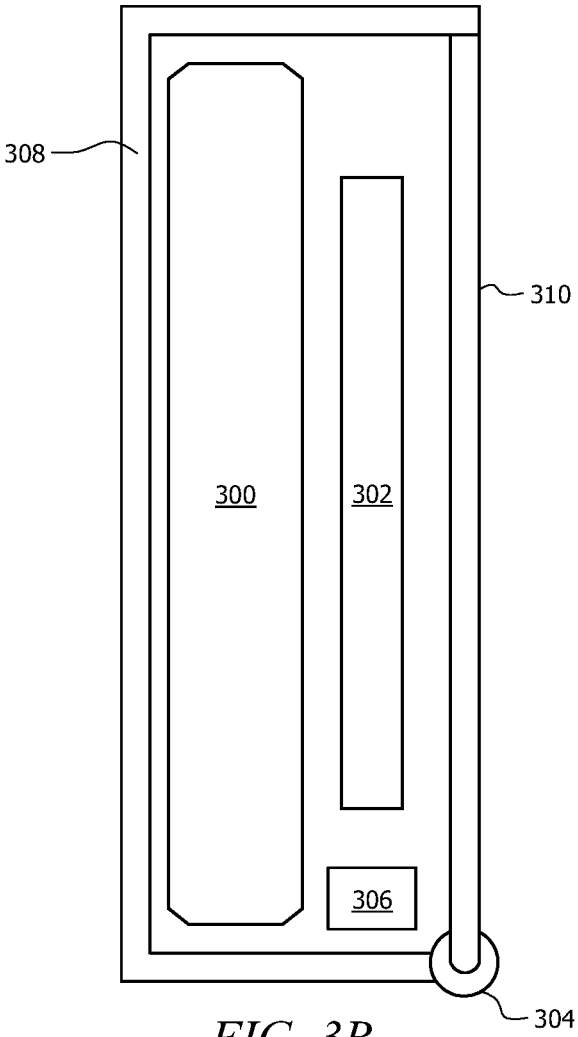
FIG. 3B is a side-view block diagram illustrating components of a folded skid-mounted separator assembly, according to one or more embodiments.

FIG. 3A is a side-view block diagram illustrating general components of a deployed skid-mounted separator assembly, according to one or more embodiments of the present disclosure. FIG. 3B is a side-view block diagram illustrating components of a folded skid-mounted separator assembly, according to one or more embodiments of the present disclosure. In certain embodiments, a skid-mounted separator assembly may comprise a first frame 308 hingedly coupled to a second frame 310 via hinge 304. One or more separators 300 may be included upon the first frame 308. In certain embodiments, one or more isolation valves 306 may be included upon the first frame 308 and/or second frame 310. In certain embodiments, one or more valve manifolds 302 may be included upon the second frame 310. During transport, the first frame 308 and second frame 310 may be parallel in a horizontal or vertical position. During production, the second frame 310 may be perpendicular to the first frame 308 and may reside at a horizontal orientation, as depicted in FIG. 3A. The first frame 308 and/or second frame 310 may be rotated approximately ninety degrees about hinge 304 in a clamshell-like manner.

In certain embodiments, one or more separators 300 may be provided upon the first frame 308. In certain embodiments, one or more junk catchers/strainers and one or more valving systems may be provided upon the second frame 310. The entire separator assembly may be mounted upon a single skid, which may be transported upon a trailer (for example, and without limitation, a silo setter). In certain embodiments, the trailer may place the entire separator assembly on the ground near a wellhead in a horizontal position; following this, the first frame 308 may be lifted approximately ninety degrees to a vertical position. In other embodiments, the trailer may place the entire separator assembly on the ground near a wellhead in a vertical position; following this, the second frame 310 may be lowered approximately ninety degrees to a horizontal position. In certain embodiments, a single trailer may serve to pick up and put down several separator assemblies in succession; it is not necessary to procure a separate trailer for each separator assembly.

In certain embodiments, two separators 300 may be provided upon a single skid. In certain embodiments, the skid may be positioned between two wellheads such that each separator may be coupled to one wellhead. In certain embodiments, the one or more separators may perform the function of a GPU, separating gases, liquids, and/or solids from one or more produced liquids and/or natural gases. In certain embodiments, the separator assembly may fully remove the need for a GPU at the wellsite. In other embodiments, the one or more separators may allow temporary flowback while the GPU is being set up at the wellsite. In certain embodiments, each separator assembly may have a junk catcher, valving system, and isolation equipment 302; a choke valve may have independent isolation equipment. In other embodiments, a separator assembly and choke valve may share isolation equipment. Separate isolation equipment 302 allows for increased operational flexibility; conversely, shared isolation equipment cuts down on capital expense, size, and weight. It is within the ability of those skilled in the art with the benefit of the present disclosure to determine the degree to which isolation equipment should be shared between elements of the present disclosure. In certain embodiments, some or all of the equipment of the separator assembly may be pre-wired and pre-connected pneumatically, such that once the skid is delivered to the wellsite, minimal setup is required.

Figure 4A:
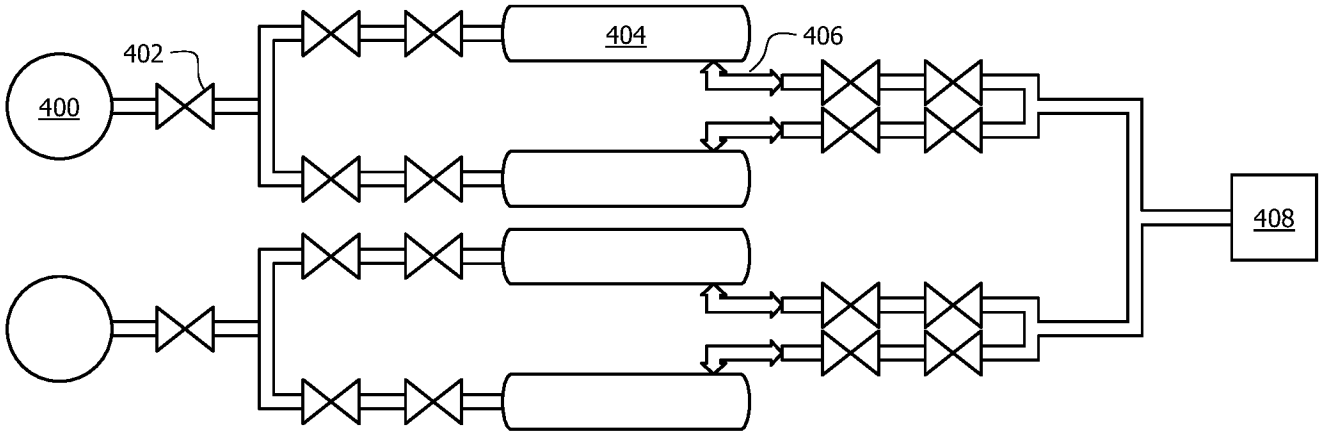
FIGS. 4A and 4B are top-view block diagrams of two possible valving systems with junk catchers, according to one or more embodiments.
Figure 4B:
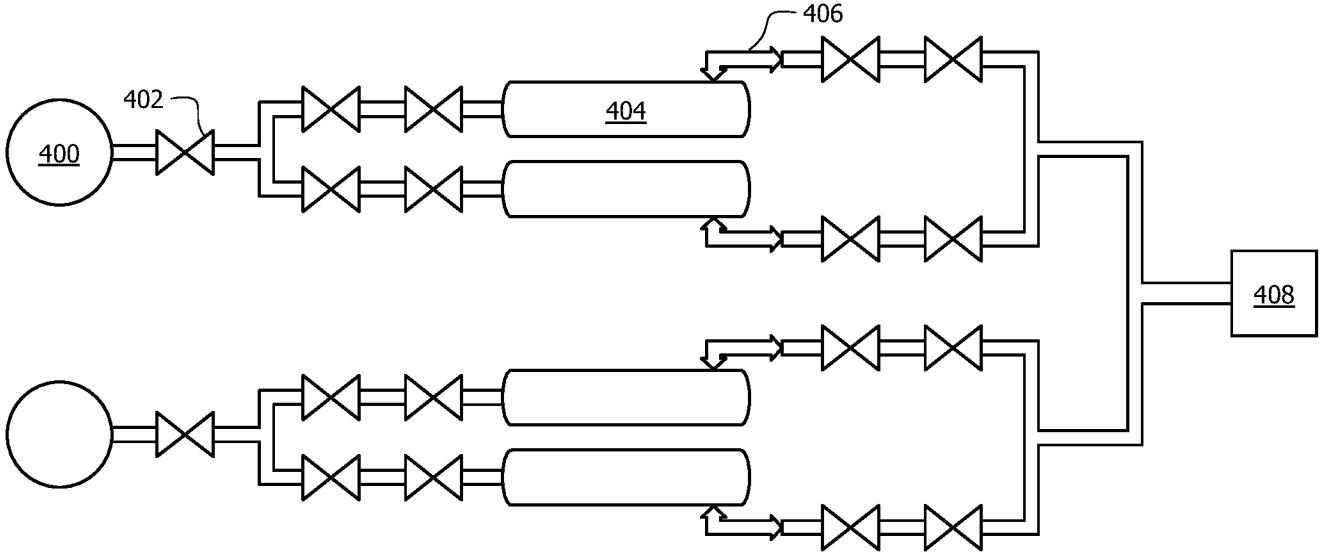

FIGS. 4A and 4B are top-view block diagrams of two possible valving systems with junk catchers, according to one or more embodiments of the present disclosure. Fluid may begin at one or more wellheads (not shown). One or more separators 400 may reside downstream from the one or more wellheads. One or more junk catchers 404 may reside downstream from the one or more separators 400. One or more valves 402 (for example, and without limitation, one or more manual valves) may be located throughout the separator assembly to allow proper control of fluid flow. One or more choke valves 406 may be included as part of the separator assembly. Once fluid has proceeded past the junk catchers, fluid may proceed downstream 408 to flow and pressure measurement devices. In certain embodiments, fluid may proceed downstream 408 to one or more atmospheric-pressure tanks. In certain embodiments, fluid may proceed downstream to one or more flow and/or pressure measurement devices 408. After passing through one or more flow and/or pressure measurement devices 408, fluid may pass to vessels or equipment (not shown) suitable to handle the water, sand, and debris that originally passed through the separator assembly. Note that FIGS. 4A and 4B depict the pathways for byproducts of production (for example, and without limitation, aqueous liquid(s), sand, and/or debris). FIGS. 4A and 4B do not depict the natural gas stream.

The embodiments depicted in FIGS. 4A and 4B are purely illustrative. Though FIGS. 4A and 4B depict two separators, fourteen valves, and four junk catchers each, embodiments having any number of one or more separators, one or more valves, and one or more junk catchers may fall within the scope of the present disclosure.

In certain embodiments, one or more junk catchers 404 may share isolation equipment with one or more choke valves 406; this is depicted in FIGS. 4A and 4B, wherein each junk catcher is depicted sharing isolation equipment with one choke valve. In certain embodiments, one or more junk catchers 404 or choke valves 406 with separate isolation systems may be fluidly coupled in parallel so that one or more of the junk catchers 404 or choke valves 406 may be isolated from the rest piping system during production without interrupting the flow. In certain embodiments, one or more sets of junk catchers 404 and choke valves 406, each of which share isolation equipment, may be fluidly coupled in parallel so that one or more of the sets of junk catchers 404 and choke valves 406 may be isolated without interrupting the flow. In certain embodiments, a separator 400 may be equipped with an isolation valve to isolate it from all downstream equipment, including, and without limitation, one or more junk catchers 404. In certain embodiments, one or more junk catchers, choke valves, and isolation systems may be disposed on the second frame of the system.

Figure 5:
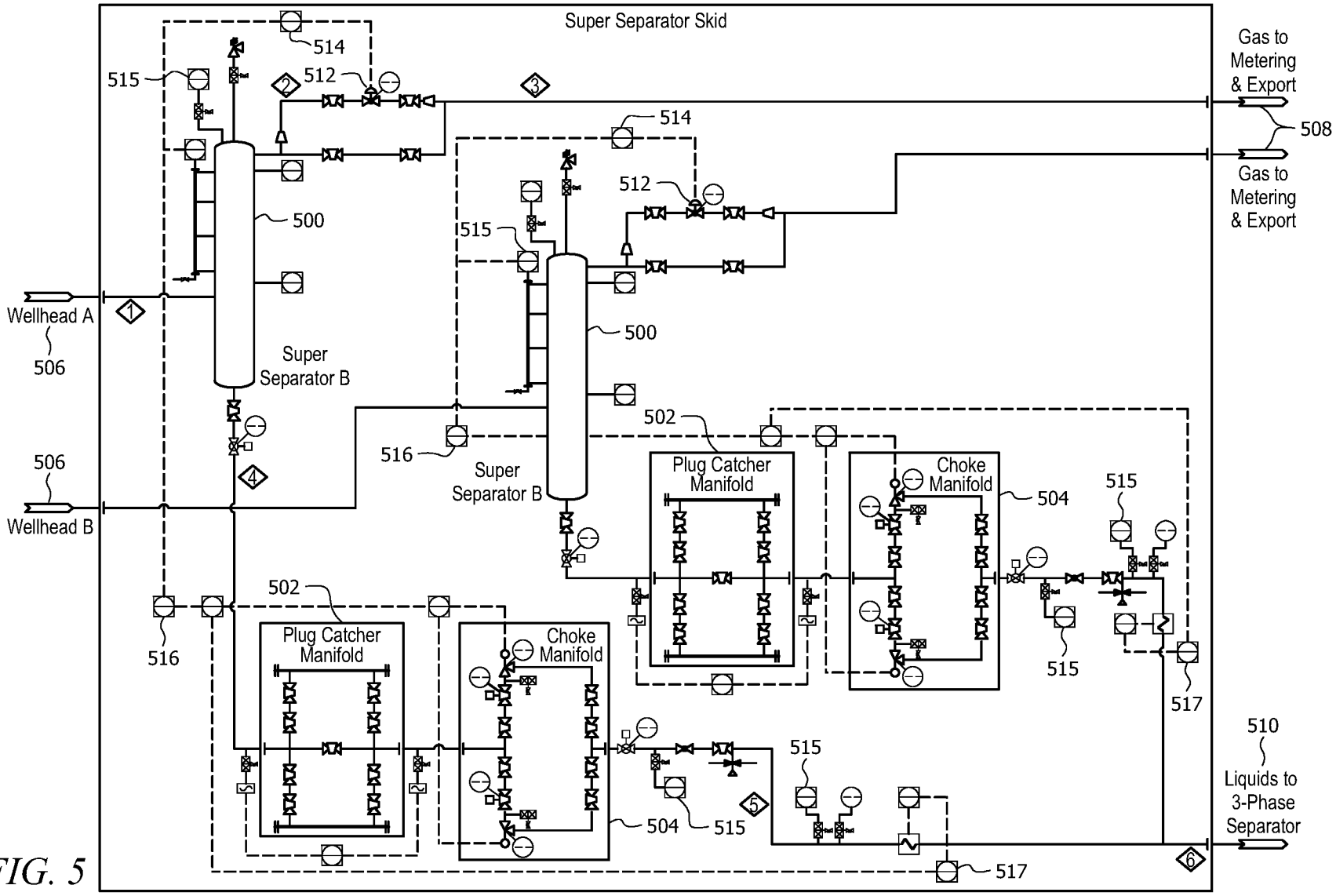
FIG. 5 is a piping and instrumentation diagram ("P&ID") of a separator assembly system, according to one or more embodiments.

FIG. 5 is a P&ID of a separator assembly system, according to one or more embodiments of the present disclosure. One or more separator vessels 500 may be located downstream from one or more wellheads 506. One or more junk catching manifolds 502 and/or one or more choke manifolds 504 may be located downstream from the one or more separator vessels 500. In certain embodiments, one or more liquids may exit the separator assembly and be sent to a multi-phase separator 510. In certain embodiments, natural gas and/or other fluids may exit the separator assembly and be sent to metering and/or conventional production equipment 508. One or more purge valves 512 may be in fluid communication with the one or more separator vessels 500. A first set of one or more level indicator controllers ("LIC" or "LICs") 514 may actuate the one or more purge valves 512. A second set of one or more LICs 516 may actuate one or more choke valves. As described herein, a LIC may be a level indicator, level controller, or any combination thereof. FIG. 5 depicts one exemplary embodiment of a valving system, but other valving systems suitable for a skid-mounted separator assembly fall within the scope of the present disclosure. For example, other valving systems within the scope of the present disclosure may include a different number of wellheads 506, separator vessels 500, junk catcher manifolds 502, choke manifolds 504, choke valves, purge valves 512, purge-actuating LICs 514, choke-actuating LICs 516, exit points (for example, and without limitation, metering and export equipment 508 and/or 3-phase separators 510), and/or other valves. In certain embodiments, one or more of the elements labeled in FIG. 5 may be entirely absent from a separator assembly. Moreover, elements may be presented in a different arrangement than depicted in FIG. 5 without departing from the scope of the present disclosure.

The systems and methods disclosed herein may separate all or a fraction of the fluid from a wellbore. In certain embodiments wherein a separator is connected to a well producing gas, oil and water, the bulk of the water may be separated while letting the gas, oil, and a portion of the water carry over to be separated by conventional production equipment.

In certain embodiments, the one or more purge-actuating LICs 514 may actuate one or more purge valves to maintain a certain liquid level in the one or more separator vessels 500. In certain embodiments, the purge-actuating LICs 514 may be used in early flowback, when a substantial portion of the produced fluids comprises water and/or solids. In certain embodiments, one or more purge valves 512 may be bypassed after a gas flow rate becomes significant. It is within the ability of one of ordinary skill in the art with the benefit of this disclosure to determine when to bypass the purge valves 512.

In certain embodiments, the one or more choke-actuating LICs 516 and/or one or more flow indicator controllers ("FIC" or "FICs") 517 may actuate whichever choke valve is currently in use. In certain embodiments, the one or more FICs 517 may be set up such that they target a fixed flow rate. In certain embodiments, the one or more choke-actuating LICs 516 may be set up such that they target a fixed liquid level in the separator vessel 500. One or more level switches may select which controller controls the choke valve based on which one would place the greatest limit on flow rate. In certain embodiments, the one or more FICs 517 may control flow rate initially, but the one or more choke-actuating LICs 516 may subsequently take precedence to ensure that a liquid level is maintained in the one or more separator vessels 500 and to ensure that no vapor blowby occurs. One or more pressure indicating transmitters 515 may be employed as an additional precaution to prevent blowby or gas loss to tanks. In certain embodiments, the vessel 500 may operate at much higher pressures than the pressure downstream of the dump/choke valve. In certain embodiments, if a pressure is sensed that is greater than the expected dump pressure, the system may be programmed to shut in.

Any of the valving systems of the present disclosure may be electric, pneumatic, or any combination thereof. The separator assembly may include one or more of isolation valves, shutdown valves, pneumatic valves, chock valves, other suitable valves known within the art, or any combination thereof. In certain embodiments, each separator vessel may be equipped with redundant isolation valving, junk catching, and/or automated level control valves. Such redundancy may be used in order to facilitate uninterrupted production during maintenance.

Though FIG. 5 depicts the junk catcher and choke valve manifolds as separate, embodiments in which the junk catcher and choke valve manifolds are combined into a single manifold fall within the scope of the present disclosure. In certain embodiments, isolation equipment may actuate automatically in response to manual input from an HMI. In certain embodiments, isolation equipment may actuate automatically such that one manifold is opened up to the flow stream and another manifold is isolated from the flow stream. In certain embodiments, isolation equipment may be actuated in order to remove and replace one or more choke valves or one or more junk catchers that have been eroded or damaged in the course of normal operation. It is within the ability of those skilled in the art and with the benefit of the present disclosure to determine when a choke valve or a junk catcher is eroded or damaged to the point where it should be replaced.

In certain embodiments, one or more logic controllers may be used to control one or more elements of the separator. The one or more logic controllers may include one or more FICs 517, one or more LICs 516, one or more pressure indicating controllers ("PIC" or "PICs") (not shown), one or more other logic controllers known in the art, or any combination thereof.

One or more purge valves 512 may be included in the valving system in some embodiments. During production, a pocket of natural gas may build up in the top of vessel 500 as the flow rate of the hydrocarbon fluid increases. In some embodiments, the flow rate of natural gas during this time may be too low for the hydrocarbon fluid to exit the vessel 500 at a steady rate. In some embodiments, the one or more purge valves 512 may open when the fluid level at the bottom of the hydrocarbon pocket reaches a first (lower) preset level. In certain embodiments, the one or more purge valves 512 may close when the fluid level reaches a second (higher) preset level. Thus, the one or more purge valves 512 may actuate intermittently in order to keep the fluid level in vessel 500 within a certain range. In some embodiments, the one or more purge valves may target a selected purge rate, which is the rate of flow through the one or more purge valves when open. Higher purge rates may more reliably mitigate buildup of the hydrocarbon pocket, while lower purge rates may more reliably avoid excessively frequent purge valve actuation. It is within the ability of one of ordinary skill in the art with the benefit of this disclosure to determine an appropriate purge rate and appropriate preset levels for the purge valves 512.

In certain embodiments, the separator assembly of the present disclosure may be fitted with or in electronic communication with one or more electronic instruments. For example, and without limitation, the separator assembly may be in electronic communication with a lighting system. The lighting system may be deliverable on the skid or may be communicatively coupled to the skid. The lighting system may be engaged via a remote interface, an interface located on-site, or an automatic system. In certain embodiments, the separator assembly may be in electronic communication with one or more surveillance cameras. Furthermore, in certain embodiments, the one or more surveillance cameras may be communicatively coupled to the lighting system. The one or more surveillance cameras may be deliverable on the skid or may be communicatively coupled to the skid. The one or more surveillance cameras may be engaged via a remote interface, an interface located on-site, or an automatic system. In certain embodiments, the separator assembly may be in electronic communication with one or more human-machine interfaces ("HMI" or "HMIs"). Furthermore, in certain embodiments, the one or more HMIs may be communicatively coupled to one or more of the lighting system or the one or more surveillance cameras. The one or more HMIs may be deliverable on the skid or may be communicatively coupled to the skid. In certain embodiments, one or more HMIs may be used to control one or more valves on the separator assembly. In certain embodiments, an HMI may act as one or more of a controller and an interface. The separator assembly may be operated remotely, locally, or any combination thereof.

In certain embodiments, one or more elements on the separator assembly (for example and without limitation, a lighting system) may require electrical power. In certain embodiments, electrical power may be provided from an electrical grid, an on-site generator, a solar panel, an on-skid generator (for example, and without limitation, a turboexpander), a backup power source (for example, and without limitation, one or more batteries), multiple variants of any of the preceding elements, or any combination thereof. The separator assembly may be electrically coupled to one or more of a gasoline generator, diesel generator, biodiesel generator, emulsified diesel generator, propane gas generator, natural gas generator, solar generator, hydrogen generator, turboexpander, or other generator known in the art. In certain embodiments, the separator assembly may pass high-pressure gas from a wellhead through a turboexpander to generate electricity. In certain embodiments, the generated electricity may be used to power one or more electronic elements on or in electronic communication with the separator assembly.

Figure 6:
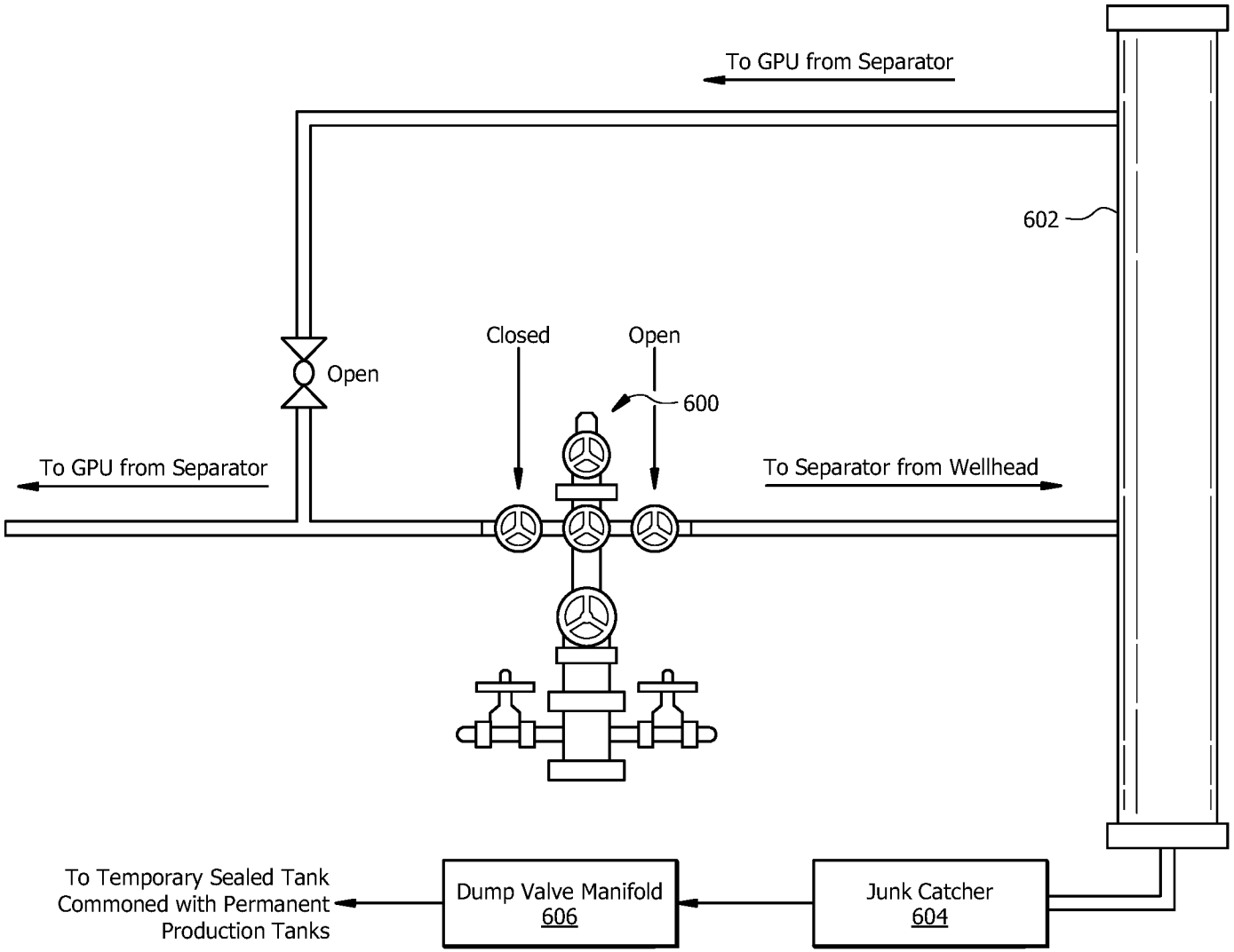
FIG. 6 is a side-view component diagram of a separator assembly attached to a wellhead, according to one or more embodiments.

FIG. 6 is a side-view component diagram of a separator assembly attached to a wellhead, according to one or more embodiments of the present disclosure. In certain embodiments, a wellhead 600 may be in fluid communication with a separator 602 (for example, and without limitation, a super separator ("SS")). Fluid may pass from the wellhead 600 to an inlet of the separator 602. In certain embodiments, natural gas may pass from a first outlet of the separator 602 to a GPU (not shown). In certain embodiments, byproducts (including, and without limitation, aqueous liquids, sand, and/or debris) may pass from a second outlet of the separator 602 to a junk catcher 604. In certain embodiments, byproducts may then pass from the junk catcher 604 to the dump valve manifold 606. In certain embodiments, byproducts may then pass from the dump valve manifold 606 to a temporary sealed tank (not shown). In certain embodiments, the temporary sealed tank may be commoned with one or more permanent production tanks. The component diagram of FIG. 6 is purely exemplary and non-limiting; other separator assembly configurations may be used without departing from the scope of the present disclosure.

Early production fluids from wellheads tend to carry a higher volume of dust and debris than later production fluids. This dust and debris can cause damaging erosion. In certain embodiments, a separator assembly may be used to separate early production fluids in order to protect expensive, fixed equipment such as a GPU. In certain embodiments, the separator 602 may be connected to both sides of the wellhead 600. During early production, a first outlet of the wellhead 600 may be open and a second outlet of the wellhead 600 may be closed. Fluid may pass from the first outlet of the wellhead 600 into the separator 602. Once separated, hydrocarbon gas and/or a minority of the fluid may pass from the first outlet of the separator 602 to the GPU (not shown). Byproducts may pass from the second outlet of the separator 602 to the junk catcher 604. After a first period of production, the first outlet of the wellhead 600 may be closed and the second outlet of the wellhead 600 may be opened, such that fluid may pass directly to the GPU without passing through the separator 602. The separator 602 may be disconnected or left attached to the wellhead 600 as needed. Accordingly, the separator 602 may process the most erosive portion of the production fluids, thereby protecting the GPU. The embodiments listed in this paragraph are purely exemplary and non-limiting. Other wellhead configurations and production schedules may be used without departing from the scope of the present disclosure, and it is within the ability of one skilled in the art having the benefit of the present disclosure to select appropriate wellhead configurations and production schedules.

While various embodiments of a separator assembly were provided in the foregoing description, those skilled in the art may make modifications and alterations to these aspects without departing from the scope and spirit of the invention. For example, it is to be understood that this disclosure contemplates that, to the extent possible, one or more features of any aspect can be combined with one or more features of any other aspect. Accordingly, the foregoing description is intended to be illustrative rather than restrictive. The invention described hereinabove is defined by the appended claims, and all changes to the invention that fall within the meaning and the range of equivalency of the claims are to be embraced within their scope.

What is claimed is:

1. A system for delivering a separator to a wellbore, comprising:

at least one mobile skid disposed on a surface near the wellbore, wherein the at least one mobile skid comprises a first frame and a second frame, wherein the first frame is hingedly coupled to the second frame, and wherein one or more of the first frame and the second frame is operable to be raised or lowered such that each of the first frame and the second frame are disposed at an angle within 5 degrees of perpendicular to the surface; and at least one separator mounted upon the at least one mobile skid.

2. The system of claim 1, wherein the at least one separator is mounted upon the first frame.

3. The system of claim 1, further comprising one or more of the following components mounted to the second frame:

a first isolation valving system;

a first junk catcher; and a first automated level control valve.

4. The system of claim 3, further comprising a liquid level sensor mounted to the first frame.

5. The system of claim 1, wherein the at least one mobile skid is removably mounted upon a trailer.

6. The system of claim 5, wherein the trailer comprises a self-setting trailer.

7. The system of claim 1, wherein the at least one separator is fluidly coupled to the wellbore, and wherein the wellbore penetrates into a subterranean surface comprising a reservoir containing one or more hydrocarbons.

8. The system of claim 7, wherein a fluid comprising one or more of gas, liquid, sand, and debris is produced from the wellbore and directed into the at least one separator.

9. The system of claim 8, wherein the at least one separator comprises:

a vessel defining an interior chamber, the vessel capable of operating at a pressure greater than the pressure of the fluid;

an inlet through which the fluid is directed into the vessel;

an outlet through which the gas is directed out of the vessel at a pressure substantially equal to the pressure of the fluid being produced from the wellbore;

at least one liquid level sensor capable of detecting a level of liquid within the interior chamber of the vessel at the pressure of the fluid being produced from the wellbore;

an electronically controlled valve in fluid communication with a lower portion of the vessel; and a controller connected to the at least one liquid level sensor and the electronically controlled valve, the controller programmed to open, close, or modulate the electronically controlled valve to regulate the combined flow of the liquid, sand and debris out of the lower portion of the vessel at least partially in response to the level of the liquid in the interior chamber of the vessel detected by the at least one liquid level sensor.

10. The system of claim 8, wherein the first frame is approximately perpendicular to the surface.

11. The system of claim 8, wherein the second frame is approximately parallel to the surface.

12. The system of claim 8, wherein at least one outlet of the at least one separator is coupled to a gas production unit (GPU).

13. The system of claim 12, wherein the GPU is in fluid communication with the at least one separator, and wherein the at least one separator is coupled to an open outlet of the wellbore and a closed outlet of the wellbore.

14. The system of claim 3, further comprising a choke valve m fluid communication with the at least one separator.

15. The system of claim 14, wherein the first junk catcher and the choke valve are in fluid communication with the first isolation valving system.

16. The system of claim 15, wherein the first isolation valving system is automated.

17. The system of claim 1, further comprising one or more electronics coupled to one or more of the first frame and the second frame, the one or more electronics comprising one or more of a camera, a light source, and a human-machine interface (HMI).

18. The system of claim 3, wherein the first isolation valving system comprises one or more electric valves, one or more pneumatic valves, or any combination thereof.

19. The system of claim 1, further comprising:

one or more choke valves;

one or more switching valves;

one or more purge valves;

one or more manual valves; or any combination thereof.

20. The system of claim 3, further comprising one or more logic controllers communicatively coupled to the first isolation valving system.

21. The system of claim 20, wherein the one or more logic controllers comprise one or more of:

a flow indicator controller (FIC);

a level indicator controller (LIC); and a pressure indicator controller (PIC).

22. The system of claim 21, further comprising one or more sensors in electronic communication with the FIC, the LIC, the PIC, the one or more logic controllers, and/or one or more human-machine interfaces (HMIs).

23. The system of claim 22, wherein one or more valves are actuated via the LIC, the FIC, the PIC, the one or more logic controllers, and/or the one or more human-machine interfaces (HMIs) at least in part based on a signal from the one or more sensors.

24. The system of claim 23, wherein the one or more sensors comprise one or more flow sensors, one or more liquid level sensors, and/or one or more pressure sensors.

25. The system of claim 3, further comprising one or more human-machine interfaces (HMIs) for system monitoring and control.

26. The system of claim 25, wherein at least one HMI is located remote from the mobile skid.

27. The system of claim 3, wherein the at least one separator is equipped with a second isolation valving system, a second junk catcher, and a second automated level control valve arranged in parallel to the first isolation valving system, the first junk catcher, and the first automated level control valve.

28. A method for delivering a separator to a wellbore, the method comprising:

transporting a mobile skid to a surface near the wellbore, the mobile skid comprising a first frame coupled to a second frame via a hinge;

coupling at least one separator to the wellbore; and raising or lowering one or more of the first frame and the second frame such that each of the first frame and the second frame are disposed at an angle within 5 degrees of perpendicular to the surface, wherein the at least one separator is mounted upon the mobile skid.

29. The method of claim 28, further comprising mounting the mobile skid upon a trailer.

30. The method of claim 29, further comprising raising or lowering one or more of the first frame and the second frame such that the second frame is disposed at an angle between 60 degrees and 120 degrees with respect to the first frame.

31. The method of claim 29, further comprising:

lowering the mobile skid such that both the first frame and the second frame are approximately parallel to the surface; and raising the first frame such that the first frame is approximately perpendicular to the surface and such that the first frame is disposed at an angle between 60 degrees and 120 degrees with respect to the second frame.

32. The method of claim 31, wherein the mobile skid is lowered before disconnecting the mobile skid from the trailer, and wherein the first frame is raised after disconnecting the mobile skid from the trailer.

33. The method of claim 29, further comprising:

lowering the second frame such that the second frame is approximately parallel to the surface and such that the second frame is disposed at an angle between 60 degrees and 120 degrees with respect to the first frame.

34. The method of claim 33, wherein the mobile skid is raised before disconnecting the mobile skid from the trailer, and wherein the second frame is lowered after disconnecting the mobile skid from the trailer.

35. The method of claim 32, further comprising:

raising the second frame relative to the first frame such that the second frame is disposed at an angle within 5 degrees of parallel to the first frame; and reconnecting the mobile skid to the trailer.

36. The method of claim 32, further comprising:

lowering the first frame relative to the second frame such that the first frame is disposed at an angle within 5 degrees of parallel to the second frame; and reconnecting the mobile skid to the trailer.

37. The method of claim 28, wherein the at least one separator is mounted upon the first frame.

38. The method of claim 28, further comprising sensing, via a liquid level sensor, a liquid level within a vessel of the at least one separator.

39. The method of claim 38, further comprising actuating at least one automated level control valve based at least in part on a signal from the liquid level sensor.

40. The method of claim 28, wherein at least one isolation valving system and at least one junk catcher are mounted upon the second frame.

41. The method of claim 28, wherein a fluid comprising one or more of gas, liquid, sand, and debris is produced from the wellbore and directed into the at least one separator.

42. The method of claim 41, wherein the at least one separator comprises:

a vessel defining an interior chamber, the vessel capable of operating at a pressure greater than the pressure of the fluid;

an inlet through which the fluid is directed into the vessel;

an outlet through which the gas is directed out of the vessel at a pressure substantially equal to the pressure of the fluid being produced from the wellbore;

at least one liquid level sensor capable of detecting a level of liquid within the interior chamber of the vessel at the pressure of the fluid being produced from the wellbore;

an electronically controlled valve in fluid communication with a lower portion of the vessel; and a controller connected to the at least one liquid level sensor and the electronically controlled valve, the controller programmed to open, close, or modulate the electronically controlled valve to regulate the combined flow of the liquid, sand and debris out of the lower portion of the vessel at least partially in response to the level of the liquid in the interior chamber of the vessel detected by the at least one liquid level sensor.

43. The method of claim 41, wherein at least one outlet of the at least one separator is coupled to a gas production unit (GPU).

44. The method of claim 43, further comprising:

coupling the at least one separator to an open outlet of the wellbore and a closed outlet of the wellbore; and allowing a portion of the fluid to flow from the at least one separator to the GPU.

45. A system, comprising:

at least one mobile skid disposed on a surface, wherein the at least one mobile skid comprises a first frame and a second frame, wherein the first frame is hingedly coupled to the second frame, and wherein one or more of the first frame and the second frame is operable to be raised or lowered such that each of the first frame and the second frame are disposed at an angle within 5 degrees of perpendicular to the surface;

at least one wellbore penetrating a subterranean surface comprising a reservoir containing one or more hydrocarbons, wherein a fluid comprising one or more of gas, liquid, sand, and debris is produced from the wellbore; and at least one separator mounted upon the at least one mobile skid and in fluid communication with the reservoir via the at least one wellbore, the at least one separator comprising:

a vessel defining an interior chamber, the vessel capable of operating at a pressure greater than the pressure of the fluid;

an inlet through which the fluid is directed from the at least one wellbore into the vessel;

an outlet through which the gas is directed out of the vessel at a pressure substantially equal to the pressure of the fluid being produced from the at least one wellbore;

at least one liquid level sensor capable of detecting a level of liquid within the interior chamber of the vessel at the pressure of the fluid being produced from the at least one wellbore;

an electronically controlled valve in fluid communication with a lower portion of the vessel; and a controller connected to the at least one liquid level sensor and the electronically controlled valve, the controller programmed to open, close, or modulate the electronically controlled valve to regulate the combined flow of the liquid, sand and debris out of the lower portion of the vessel at least partially in response to the level of the liquid in the interior chamber of the vessel detected by the at least one liquid level sensor.

46. The system of claim 45, wherein the at least one separator is mounted upon the first frame.

47. The system of claim 45, further comprising one or more of the following components mounted to the second frame:

a first isolation valving system;

a first junk catcher; and a first automated level control valve.

48. The system of claim 45, wherein the at least one mobile skid is removably mounted upon a trailer.

49. The system of claim 48, wherein the trailer comprises a self-setting trailer.

50. The system of claim 45, wherein the first frame is approximately perpendicular to the subterranean surface.

51. The system of claim 45, wherein the second frame is approximately parallel to the subterranean surface.

52. The system of claim 45, wherein at least one outlet of the at least one separator is coupled to a gas production unit (GPU).

53. The system of claim 52, wherein the GPU is in fluid communication with the at least one separator, and wherein the at least one separator is coupled to an open outlet of the wellbore and a closed outlet of the wellbore.

54. The system of claim 47, further comprising a choke valve in fluid communication with the at least one separator.

55. The system of claim 54, wherein the first junk catcher and the choke valve are in fluid communication with the first isolation valving system.

56. The system of claim 55, wherein the first isolation valving system is automated.

57. The system of claim 45, further comprising one or more electronics coupled to one or more of the first frame and the second frame, the one or more electronics comprising one or more of a camera, a light source, and a human-machine interface (HMI).

58. The system of claim 47, wherein the first isolation valving system comprises one or more electric valves, one or more pneumatic valves, or any combination thereof.

59. The system of claim 45, further comprising:

one or more choke valves;

one or more switching valves;

one or more purge valves;

one or more manual valves; or any combination thereof.

60. The system of claim 47, further comprising one or more logic controllers communicatively coupled to the first isolation valving system.

61. The system of claim 60, wherein the one or more logic controllers comprise one or more of:

a flow indicator controller (FIC);

a level indicator controller (LIC); and a pressure indicator controller (PIC).

62. The system of claim 61, further comprising one or more sensors in electronic communication with the FIC, the LIC, the PIC, the one or more logic controllers, and/or one or more human-machine interfaces HMIs.

63. The system of claim 62, wherein one or more valves are actuated via the LIC the FIC, the PIC, the one or more logic controllers, and/or the one or more human-machine interfaces (HMIs) at least in part based on a signal from the one or more sensors.

64. The system of claim 63, wherein the one or more sensors comprise one or more flow sensors, one or more liquid level sensors, and/or one or more pressure sensors.

65. The system of claim 47, further comprising one or more human-machine interfaces (HMIs) for system monitoring and control.

66. The system of claim 65, wherein at least one HMI is located remote from the mobile skid.

67. The system of claim 47, wherein the at least one separator is equipped with a second isolation valving system, a second junk catcher, and a second automated level control valve arranged in parallel to the first isolation valving system, the first junk catcher, and the first automated level control valve.

68. A system for delivering a separator to a wellbore, comprising:

at least one mobile skid disposed on a surface near the wellbore, wherein the at least one mobile skid comprises a first frame and a second frame, wherein the first frame is hingedly coupled to the second frame via a hinge, and wherein the hinge is operable to close such that both the first frame and the second frame become disposed at an angle within 5 degrees of perpendicular to the surface; and at least one separator mounted upon the at least one mobile skid.

69. The system of claim 68, wherein the at least one separator is mounted upon the first frame.

70. The system of claim 68, further comprising one or more of the following components mounted to the second frame:

a first isolation valving system;

a first junk catcher; and a first automated level control valve.

71. The system of claim 70, further comprising a liquid level sensor mounted to the first frame.

72. The system of claim 68, wherein the at least one mobile skid is removably mounted upon a trailer.

73. The system of claim 72, wherein the trailer comprises a self-setting trailer.

74. The system of claim 68, wherein the at least one separator is fluidly coupled to the wellbore, and wherein the wellbore penetrates into a subterranean surface comprising a reservoir containing one or more hydrocarbons.

75. The system of claim 74, wherein a fluid comprising one or more of gas, liquid, sand, and debris is produced from the wellbore and directed into the at least one separator.

76. The system of claim 75, wherein the at least one separator comprises:

a vessel defining an interior chamber, the vessel capable of operating at a pressure greater than the pressure of the fluid;

an inlet through which the fluid is directed into the vessel;

an outlet through which the gas is directed out of the vessel at a pressure substantially equal to the pressure of the fluid being produced from the wellbore;

at least one liquid level sensor capable of detecting a level of liquid within the interior chamber of the vessel at the pressure of the fluid being produced from the wellbore;

an electronically controlled valve in fluid communication with a lower portion of the vessel; and a controller connected to the at least one liquid level sensor and the electronically controlled valve, the controller programmed to open, close, or modulate the electronically controlled valve to regulate the combined flow of the liquid, sand and debris out of the lower portion of the vessel at least partially in response to the level of the liquid in the interior chamber of the vessel detected by the at least one liquid level sensor.

77. The system of claim 75, wherein the first frame is approximately perpendicular to the surface.

78. The system of claim 75, wherein the second frame is approximately parallel to the surface.

79. The system of claim 75, wherein at least one outlet of the at least one separator is coupled to a gas production unit (GPU).

80. The system of claim 79, wherein the GPU is in fluid communication with the at least one separator, and wherein the at least one separator is coupled to an open outlet of the wellbore and a closed outlet of the wellbore.

81. The system of claim 70, further comprising a choke valve in fluid communication with the at least one separator.

82. The system of claim 81, wherein the first junk catcher and the choke valve are in fluid communication with the first isolation valving system.

83. The system of claim 82, wherein the first isolation valving system is automated.

84. The system of claim 68, further comprising one or more electronics coupled to one or more of the first frame and the second frame, the one or more electronics comprising one or more of a camera, a light source, and a human-machine interface (HMI).

85. The system of claim 70, wherein the first isolation valving system comprises one or more electric valves, one or more pneumatic valves, or any combination thereof.

86. The system of claim 68, further comprising:

one or more choke valves;

one or more switching valves;

one or more purge valves;

one or more manual valves; or any combination thereof.

87. The system of claim 70, further comprising one or more logic controllers communicatively coupled to the first isolation valving system.

88. The system of claim 87, wherein the one or more logic controllers comprise one or more of:

a flow indicator controller (FIC);

a level indicator controller (LIC); and a pressure indicator controller (PIC).

89. The system of claim 88, further comprising one or more sensors in electronic communication with the FIC, the LIC, the PIC, the one or more logic controllers, and/or one or more human-machine interfaces (HMIs).

90. The system of claim 89, wherein one or more valves are actuated via the LIC, the FIC, the PIC, the one or more logic controllers, and/or the one or more human-machine interfaces (HMIs) at least in part based on a signal from the one or more sensors.

91. The system of claim 90, wherein the one or more sensors comprise one or more flow sensors, one or more liquid level sensors, and/or one or more pressure sensors.

92. The system of claim 70, further comprising one or more human-machine interfaces (HMIs) for system monitoring and control.

93. The system of claim 92, wherein at least one HMI is located remote from the mobile skid.

94. The system of claim 93, wherein the at least one separator is equipped with a second isolation valving system, a second junk catcher, and a second automated level control valve arranged in parallel to the first isolation valving system, the first junk catcher, and the first automated level control valve.

* * * * *